United States Patent [19]

Champaneria et al.

[11] 4,325,857

[45] Apr. 20, 1982

[54] DURABLE ANTISOLING COATINGS FOR TEXTILE FILAMENTS

[75] Inventors: Nitin J. Champaneria, Seaford, Del.; Lee R. Harper, Media, Pa.; Edward A. Hosegood, Ocean City, Md.

[73] Assignee: E. I. Du Pont de Nemours and Company, Wilmington, Del.

[21] Appl. No.: 149,334

[22] Filed: May 13, 1980

[51] Int. Cl.[3] ..... C08L 63/00

[52] U.S. Cl. ..... 523/412; 523/406; 523/426

[58] Field of Search ..... 260/29.6 NR, 29.6 WB, 260/29.6 MN, 29.6 TA, 29.6 H, 29.6 HN, 29.6 F, 29.2 TN, 29.2 EP; 525/113

[56] References Cited

U.S. PATENT DOCUMENTS

| | | | |
|---|---|---|---|
| 3,484,281 | 12/1969 | Guenthner et al. | 117/121 |
| 3,916,053 | 10/1975 | Sherman et al. | 428/96 |
| 3,923,715 | 12/1975 | Dettre et al. | 260/29.6 R |
| 3,969,300 | 7/1976 | Nagata et al. | 260/29.4 UA |
| 4,021,396 | 5/1977 | Wu | 260/29.6 NR |
| 4,029,585 | 6/1977 | Dettre et al. | 252/8.6 |
| 4,043,964 | 8/1977 | Sherman et al. | 260/29.6 RB |
| 4,190,545 | 2/1980 | Marshall et al. | 252/8.75 |
| 4,192,754 | 3/1980 | Marshall et al. | 252/8.8 |

*Primary Examiner*—John Kight, III
*Assistant Examiner*—Amelia B. Yarbrough

[57] ABSTRACT

A durable antisoiling coating composition for textile filaments and articles made therefrom comprises a perfluoroalkyl ester of a citric acid urethane and fluorinated alcohols in combination with a modified epoxy resin which is the reaction product of a carboxyl-functional vinyl polymer, an epoxy resin and a tertiary amine. The composition can be applied as an aqueous dispersion, including a non-ionic textile lubricant based on poly(ethylene glycol). The dispersion can be used as a spin finish to provide durable protection to filaments, particularly nylon filaments.

6 Claims, No Drawings

DURABLE ANTISOLING COATINGS FOR TEXTILE FILAMENTS

DESCRIPTION

1. Technical Field

This invention concerns aqueous dispersions of perfluoroalkyl esters in combination with a resin made from a carboxyl-functional vinyl polymer, an epoxy resin and a tertiary amine which dispersions are useful for providing durable antisoiling protection to synthetic textile filaments, fibers and articles made therefrom. The invention also concerns the process of using such dispersions as a spin-finish during the manufacture of synthetic textile filaments and to filaments made thereby.

2. Background Art

U.S. Pat. No. 4,029,585 teaches the use of aqueous dispersions of citric acid urethane esters of perfluoroalkyl alcohols to impart soil resistance to textile articles, such as carpets, treated therewith. The soil repellancy and durability of the treatment are enhanced by blending into the fluorochemical dispersion an aqueous latex of a nonfluorinated vinyl polymer such as poly(methyl methacrylate). Although such dispersions are effective when applied to the finished textile article, such as to a dyed carpet, attempts to apply them to textile filaments during their manufacture, so as to eliminate the extra expense incurred by separately treating the otherwise finished carpet were not successful. Problems which can be encountered by applying such coatings to textile filaments during their manufacture include undesirable deposits on equipment and failure to survive processing with sufficient durability to perform effectively in the finished article.

An object of this invention is an antisoiling composition which can be applied to textile filaments as a spin-finish during their manufacture without disrupting yarn processability and which remains durable to subsequent processing and dyeing treatments in order to perform effectively in the finished textile article. Other objects will be apparent from the following description of the invention.

DISCLOSURE OF THE INVENTION

This invention concerns the use of perfluoroalkylesters of urethanes of citric acid of the type described and claimed in U.S. Pat. No. 4,029,585, the specification and claims of which are incorporated herein by way of reference, in combination with an acrylic modified epoxy resin which consists of the reaction product of a carboxyl-functional vinyl polymer, an epoxy resin containing two terminal 1,2-epoxy groups and a tertiary amine. The reaction product preferably is an acrylic terpolymer/diquaternized polyalcohol. Such reaction products are useful as water-based coating compositions in the automotive and metal canning finishes industry.

Accordingly, this invention provides a polymeric antisoiling coating composition for textile fibers comprising an aqueous dispersion of (1) a perfluoroalkylester of a citric acid urethane preferably a bis-urethane,, and a fluorinated alcohol having the formula $C_nF_{2n+1}(CH_2)_mOH$ wherein n is 6 to 14 and m is 2, the ester preferably being volatile at about 200° C. to 300° C., and of (2) the reaction product of (A) not less than 50%, based on the weight of (A) plus (B), preferably not less than 65%, most preferably about 78%, of an epoxy resin containing, on the average, two terminal 1,2-epoxy groups per molecule and having an epoxy equivalent weight of 750–5000, preferably about 1500–4000, most preferably about 3000;

(B) a carboxyl-functional vinyl polymer in an amount sufficient to provide at least 1.25, preferably at least about 1.75, most preferably about 4.6, equivalents of carboxyl groups, when the source of the carboxyl group is a monoprotic acid, and at least 2.0 equivalents of carboxyl groups, when the source of such groups is a diprotic acid, per equivalent of 1,2-epoxy groups in the epoxy resin of (A), said polymer having a weight average molecular weight (determined by light scattering) of 10,000–160,000, preferably about 10,000–80,000, most preferably about 13,000–18,000, and an acid number of 100–500, preferably about 150–350, most preferably about 300; and (C) an aqueous solution of at least 1.25, preferably at least about 1.75, most preferably about 3.0, equivalents of a tertiary amine per equivalent of 1,2-epoxy groups in the epoxy resin of (A), said tertiary amine being selected from the group consisting of $R_1R_2R_3N$, pyridine, N-methyl pyrrole, N-methyl piperidine, N-methyl pyrrolidine, N-methyl morpholine, and mixtures therein and wherein $R_1$ and $R_2$ are substituted or unsubstituted monovalent alkyl groups containing one or two carbon atoms in the alkyl portion and $R_3$ is a substituted or unsubstituted monovalent alkyl group containing 1–4 carbon atoms; and (D) optionally, 10–90% of the amount required for stoichiometric reaction with the carboxyl-functional polymer of (B) of at least one primary, secondary or tertiary amine or monofunctional quaternary ammonium hydroxide; wherein Y is at least about $6+0.75(2^X)$ wherein Y is the milliequivalent of carboxyl groups neutralized by primary, secondary or tertiary amine or monofunctional quaternary ammonium hydroxide per 100 grams of acid polymer plus epoxy, and X is the epoxy equivalent weight divided by 1000; and wherein for increasing ratios of carboxyl groups to 1,2-epoxy groups, the amount of amine is increased to keep the carboxyl-functional polymer water dispersible, with said ester being present in said dispersion in a ratio in parts by weight to said reaction product within the range of 1:1 to 12:1.

Preferred esters of the invention, based on processability of the treated yarn and durability of the antisoiling protection ultimately provided, with respect to freedom from unwanted deposits, surviving subsequent textile processing, and durability in use of the final textile article, are the bis-urethanes formed from citric acid fully esterified (triester) with the perfluoroalkyl alcohol(s) and from aliphatic alpha, omega-diisocyanates, particularly 1,6-hexamethylene diisocyanate.

Based on the same considerations, preferred vinyl resins for use in making the modified epoxy resin reaction product are the terpolymers of styrene/ethylacrylate/methacrylic acid, and particularly such terpolymers wherein the monomers are in a mol ratio to one another respectively of about 1:1:2.

The water-borne coating composition of the invention includes a solution or dispersion of the reaction products of an epoxy resin, a tertiary amine, and a carboxyl-functional polymer. By mixing these components in a random order and utilizing aqueous solutions of highly specific tertiary amines such as dimethyl ethanol amine, a stable, water soluble or dispersible salt of a polymeric quaternary ammonium hydroxide and a carboxyl-functional polymer results which can be crosslinked without the addition of external crosslinking agents. The solution and dispersion are both infinitely dilutable with water.

Whether the coating composition is a solution or a dispersion is largely dependent on the nature of the particular amine used, the stoichiometry of the system, and the epoxy equivalent weight. Even when the composition is opaque some of the resinous components may be dissolved, and when the composition appears to be a clear solution it is possible that small amounts of the components are in a dispersed state. For sake of simplicity, hereafter the term "dispersion" will be used to denote the water-borne coating composition.

The dispersion, with or without an external crosslinking agent, as prepared, usually has a pH of above 7. Upon drying, a hard, solvent-resistant film having excellent resistance to acids, bases, hot water, and detergent results.

The low molecular weight epoxy resin to be utilized in the present invention are commonly known in the art. One class of such resins is based on the condensation products of epichlorohydrin and bisphenol A. The epoxy resins utilized in this invention contain an average of two terminal 1,2-epoxy groups per molecule and are in the epoxy equivalent weight range of 750–5000, preferably 1500–4000. They can also contain substituted aromatic rings.

One such preferred epoxy resin is "Epon 1004" having an epoxy equivalent weight of 875–1025, with an average of about 950±50. The epoxy equivalent weight is defined as the grams of resin containing 1 gram-equivalent of epoxide as measured by ASTM-D-1652. The coating composition containing "Epon 1004" affords a glossy, flexible, chemically-resistant film. Another preferred epoxy resin is "Epon 1007" having an epoxy equivalent weight of 2000–2500, with an average of about 2175±50. The coating composition containing "Epon 1007" affords glossy, tough, flexible films upon cure. Another preferred epoxy is an analog of "Epon 1009" with an average epoxy equivalent weight of 3000 made by chain extending "Epon 829" (EW 195) with bisphenol A.

The quantity of the epoxy resin to be utilized in the coating composition of this invention is determined in relation to the amount of carboxyl-functional polymer and the relative amounts are dependent on the end use application of the coating but there must be at least 50%, preferably in the range of 65–90%, of epoxy resin present. There must be, furthermore, at least 1.25, preferably at least 1.75, and most preferably about 4.6, equivalents of carboxyl groups per equivalent of 1,2-epoxy groups in the epoxy resin. This minimum equivalent requirement is valid for those carboxyl-functional polymers which contain monoprotic acids derived from alpha, beta-ethylenically unsaturated acid monomers such as acrylic acid, methacrylic acid, monoesters of alkanols having 1–8 carbon atoms with diacids, such as maleic acid, itaconic acid, fumaric acid, mesaconic acid, citraconic acid and the like, and mixtures thereof. For those carboxyl-functional polymers which contain diprotic acids derived from diacids such as maleic acid, itaconic acid, fumaric acid, mesaconic acid, citraconic acid, and mixtures thereof, the minimum requirement is 2.0 equivalents, preferably at least 2.5 equivalents, of carboxyl group per 1,2-epoxy groups. Usually, no more than 10.0, and preferably no more than 6.0, equivalents of carboxyl groups, per equivalent of 1,2-epoxy groups, will be present.

The carboxyl-functional polymers utilized in this invention are prepared by conventional free radical polymerization techniques from at least one ethylenically unsaturated monomer and at least one ethylenically unsaturated acid monomer. The choice of the alpha, beta-unsaturated monomer(s) is dictated by the intended end use of the coating composition and is practically unlimited. A variety of acid monomers can be used; their selection is dependent on the desired final polymer properties.

This acid monomer can be an ethylenically unsaturated acid, monoprotic or diprotic, anhydride or monoester of a dibasic acid, which is copolymerizable with the other monomer(s) used to prepare the polymer.

The most preferred acid monomers are acrylic acid, methacrylic acid, and itaconic acid.

The acid number of the polymers is 100–500, which corresponds to concentrations of about 10–77% of the acid monomers by weight of the polymer. The acid number is the number of milligrams of potassium hydroxide required to neutralize one gram of the polymer. For purposes of illustration, an acid number of 100 corresponds to the presence in the polymer of either 12.8% acrylic acid, 15.3% of methacrylic acid, 11.5% of itaconic acid, or 10.3% of maleic or fumaric acid. An acid number of 500 corresponds to 64% of acrylic acid, 76.5% of methacrylic acid, 57.5% of itaconic acid, or 51.5% of maleic or fumaric acid in the polymer. Preferred acid number values are 150–350.

Vinyl aromatic monomers are commonly utilized to be copolymerized with the acid monomers.

Illustrative of these monomers are styrene, alpha-methyl styrene, vinyl toluene, and the like. The best polymers, in terms of final film properties, are those in which this type of monomer is styrene. The vinyl aromatic monomers can be present from 0–80% of the carboxyl-functional polymer, preferably from 40–80%, most preferably from 40–70%, and specifically at concentrations of about 42, 53, and 66%. For some purposes 10–45% may be preferred and, in some applications, the polymer contains no such monomer.

Other suitable monomers are esters of acrylic acid, methacrylic acid or mixtures thereof with $C_1$–$C_{16}$ alkanols. Preferred esters are the methyl, ethyl, propyl, n-butyl isobutyl, and 2-ethylhexyl esters of acrylic acid or methacrylic acid or mixtures of such esters. These esters can be present in concentrations of 0–97%, preferably 50–90% for automotive finishes and coil coatings and, for can coatings and appliance finishes, preferably 0–50%.

The polymers utilized in the water-borne coating composition of this invention have a weight average molecular weight, as determined by light scattering or, more conveniently, gel permeation chromatography, using a polystyrene standard, calibrated by light scattering methods of about 10,000–160,000. The preferred weight average molecular weight range is 10,000–80,000. For some applications a 13,000–18,000 molecular weight is preferred.

During the preparation of the coating composition of this invention, an aqueous solution of a tertiary amine, specified below, is brought in contact with a solution of an epoxy resin in organic liquid(s) or with a solution of an epoxy resin and a carboxyl-functional polymer. A wide variety of organic liquids can be used to dissolve the epoxy resins and the carboxyl-functional polymers. Among the most commonly used solvents are alcohols such as isopropanol, the butyl alcohols, 2-hydroxy-4-methyl-pentane, 2-ethylhexyl alcohol, cyclohexanol, glycols such as ethylene glycol, diethylene glycol, 1,3-butylene glycol, ether alcohols such as ethylene glycol mono-ethyl ether, ethylene glycol mono-butyl ether, diethylene glycol mono-methyl ether, mixtures thereof, and many aliphatic and aromatic hydrocarbons if used admixed with at least one of the above.

While the exact mode of the reaction is not fully understood, it is believed that the tertiary amine first reacts with the carboxyl-functional polymer to form the corresponding salt which, in turn, can dissociate to allow the amine to react with the 1,2-epoxy groups of the epoxy resin. It is also possible, however, that the tertiary amine reacts directly with the 1,2-epoxy groups. In either case, the resulting quaternary ammonium hydroxide can react with the carboxyl-functional polymer to yield a polymeric quaternary ammonium-amine mixed salt of a polymeric acid.

While most tertiary amines react with epoxy resins to form quaternary ammonium hydroxides, the preparation of the water-borne coating composition of this invention is carried out utilizing at least one tertiary amino selected from the group: $R_1R_2R_3N$, N-methyl pyrrolidine, N-methyl morpholine, pyridine, N-methyl pyrrole, N-methyl piperidine, and mixtures thereof, wherein $R_1$ and $R_2$ are substituted or unsubstituted monovalent alkyl groups containing one or two carbon atoms in the alkyl portion and $R_3$ is a substituted or unsubstituted monovalent alkyl group containing 1–4 carbon atoms. Some examples of $R_1R_2R_3N$ are: trimethyl amine, dimethyl ethanol amine (also known as dimethyl amino ethanol), methyl diethanol amine, ethyl methyl ethanol amine, dimethyl ethyl amine, dimethyl propyl amine, dimethyl 3-hydroxy-1-propyl amine, dimethylbenzyl amine, dimethyl 2-hydroxy-1-propyl amine, diethyl methyl amine, dimethyl 1-hydroxy-2-propyl amine, and mixtures thereof. Most preferably trimethyl amine or dimethyl ethanol amine is used.

The amount of tertiary amine needed in the preparation of the water-borne coating composition of this invention is determined by two factors. As a minimum, there is required at least 1.25 equivalents of tertiary amine per equivalent of 1,2-epoxy groups, preferably at least 1.75 equivalents, more preferably 3.0, for the formation of stable dispersions. As the ratio of the number of carboxyl groups in the carboxyl-functional polymer to the number of 1,2-epoxy groups in the epoxy resin increases, the amount of amine is also increased to keep the carboxyl-functional polymer water dispersible. This excess amine is believed to form a salt with some or all of the excess carboxyl groups of the polymer. It is preferred that no excess amine, over the total number of equivalents of carboxyl groups, be used in the coating composition of this invention. The amine utilized in excess of the 1.25 equivalents of the highly specific tertiary amine per equivalent of 1,2-epoxy groups need not be the same as, nor does it necessarily have to be selected from the group of, the highly specific tertiary amines. Any primary, secondary or tertiary amine or monofunctional quaternary ammonium hydroxide can be utilized in neutralizing carboxyl groups of the carboxyl-functional polymer which are not already neutralized.

This invention also provides an improved process for making filaments of a synthetic linear polycarbonamide having soil-resistant properties wherein the filaments are melt-spun, solidified in air and a textile spin-finish composition is applied to the freshly solidified filaments prior to further processing wherein the improvement comprises applying as the spin-finish a composition (of this invention as above) comprising an aqueous dispersion of a perfluoroalkylester and a modified epoxy resin of the type described hereinbefore and in addition a non-ionic textile lubricant based on poly(ethylene glycol). Preferred textile lubricants include n-butyl initiated random copolymers of ethylene oxide/propylene oxide in a 50:50 mol ratio, particularly at a molecular weight corresponding to a SUS viscosity of 170.

In order to reduce accumulation of objectionable deposits on processing rolls it is beneficial to use the random copolymer lubricants of ethylene oxide/propylene oxide described above in combination with a lubricant consisting of an ethoxylated castor oil, particularly one consisting of one mol of castor oil reacted with 200 mols of ethylene oxide.

The above mentioned random copolymer lubricant and castor oil base lubricant are particularly effective in a ratio by weight to one another of about 7:1.

To obtain the desired amount of finish under normal conditions of finish application during spinning the aqueous dispersion used as the spin finish normally should have a concentration of finish solids in water of about 5 to about 25% by weight, preferably 5 to 15%. As the concentration is increased the finish composition becomes more viscous which can cause difficulty in application; as the finish becomes more dilute greater amounts of the dispersion on the yarn are required which can result in unnecessarily high amounts of water on yarn.

The concentration of the finish and the rate of application to the filaments are preferably adjusted to provide from about 250 to about 1600 parts per million of fluorine on the filaments, and more preferably from about 600 to 1200 parts per million (ppm). In order to survive subsequent processing and to provide adequate amounts in the final product amounts in the upper range of fluorine concentration are preferred for application to filaments which are to be used in making staple fibers. Lesser concentrations than required for staple fibers can be used for filaments in bulked continuous filament yarns.

At some stage of processing prior to the filaments being subjected to a scouring or dyeing operation the treated filaments should be subjected to heat in order to thoroughly dry and cure the resins on the surface of the filaments. Such heating operations are commonly encountered under processing conditions such as from heated draw rolls, hot fluid jet bulking, yarn heat-setting, twist-setting and so forth.

Excessive amounts of textile lubricants in the finish composition can interfere in the durability and effectiveness of the antisoiling ingredients. Effective operation and performance are obtained when the ratio of lubricant to the ester component is of 2:1 to 1:1 by weight. Higher ratios of lubricant to ester can be employed but at some sacrifice to the resistance of the antisoiling ingredients to removal during dyeing of the filaments, particularly under basic dyeing conditions such as a pH of about 9.0.

The aqueous dispersions of the invention are useful for imparting soil-resistance to sythetic textile filaments in general such as those of polyesters and polycarbonamides, but are found to be particularly beneficial when used on the latter, and more particularly on filaments of 6-nylon and 66-nylon, or poly(epilson-caproamide) and (polyhexamethylene adipamide), respectively.

This invention is particularly effective for providing stain and soil resistant properties to filaments and yarns for use in carpets. This includes yarns both of continuous filaments and of staple fibers. Carpets prepared from yarns treated according to the invention exhibit outstanding dry soil resistance in wear tests comparable to known treatments topically applied to the finished carpet.

The dispersion may be applied to the filaments at any stage of processing or use including the finished article, but are of particular advantage versus known commercial products when applied as a primary spin-finish.

It is preferred that the finished textile article ready for use contain a sufficient amount of the perfluoroalkylester in order to provide at least about 250 ppm of fluorine.

The aqueous dispersions of this invention provide a significant advantage when applied to filaments of freshly solidified polycarbonamides, prior to further processing such as drawing and crimping. Conventional crimping operations can be employed including the use of a hot fluid jet or a stuffer-box apparatus as are well known in the art.

This invention also comprehends yarns comprised of filaments containing the dispersions of this invention and coatings deposited therefrom, particularly filaments of a synthetic linear polycarbonamide containing on their surface a coating comprised of the perfluoroalkylalcohol citric acid urethane of this invention and the acrylic modified epoxy resin reaction products of the invention in an amount sufficient to provide some 250 to 1600 ppm of fluorine on weight of the filament.

Filaments in addition to containing compositions with textile lubricants as described heretofore may also contain a secondary textile finish as needed for handling and processing, including known textile finish agents such as coconut oil.

Filaments prepared according to the invention can be processed in the conventional manner to provide finished textile articles having outstanding dry soil resistance in use.

The usual care must be practiced as known to one skilled in the art of preparing finish compositions for textile applications to avoid mixing of incompatible components such as incompatible highly ionic materials. Consequently because of the ionic nature of the modified resin the use of ionic dispersing agents is preferably avoided, or at least minimized. Consequently the use of non-ionic textile lubricants are required. Therefore dispersing agents for the various components such as the fluoroester for making up the final aqueous dispersion must be given due consideration.

The ethoxylated castor oil lubricant is particularly effective for controlling deposits of the acrylic modified resin on yarn contacting surfaces, such as the feed and draw rolls. However, too much lubricant tends to reduce effectiveness of the coating. For this reason it is preferred that the ratio by weight of the ethoxylated castor oil to the modified resin be in a ratio of about 1.5 to 1. The ratio can be adjusted to the desired degree to control sticky or hard deposits as the case may be.

This invention is particularly useful on filaments for carpet yarns. Such yarns commonly involve yarn deniers of greater than 500 and up to 5000. The filaments can have a denier per filament of about 1 to 25. The filaments may be of any desired cross section including round, non-round such as trilobal and hollow filament. The filaments may contain known delustering agents such has titanium dioxide pigments or dispersed striations of an extractable poly(ethylene glycol) as known in the art. This invention is particularly beneficial when used on trilobal nylon filaments having a high modification ratio such as greater than 2.0 and which contain little or no delusterant.

Since the modified epoxy resin of this invention as applied to the filaments is substantially free from epoxide groups, the dispersions of this invention avoid problems of possible skin irritation to operators and people handling the yarn which can result from the use of compositions containing unreacted epoxide.

The soil-resistant filaments of this invention also exhibit good dye uniformity in both Beck and in Kuesters dyeing equipment.

Determination of Fluorine on Yarn

The sample is burned in an oxygen flask, fluoride absorbed in a sodium hydroxide solution, the pH and ionic strength adjusted, and the concentration (activity) of fluoride ion measured potentiometrically.

Measurement of fluoride ion concentration (activity) is made using a specific ion electrode. The electrode sensing element is a lanthanum fluoride single crystal membrane which separates an internal filling solution from the sample solution. This single crystal is an ionic conductor for fluoride ion and fluoride ion alone. Because the internal filling solution contains fixed levels of both fluoride and chloride ion, a constant potential is developed between the Ag/AgCl internal reference electrode and the filling solution, and also between the filling solution and inside surface of the single crystal. Thus, changes in electrode potential are due only to changes in sample fluoride ion concentration.

The electrode does not respond to other anions such as $Cl^-$, $Br^-$, $I^-$, $SO_4^-$, $HCO_3^-$, $NO_3^-$, $PO_4^{-3}$, or acetate, even when present in an excess of a thousandfold or more. In solutions with pH below 5, hydrogen ion complexes a portion of the fluoride ion, forming HF or $HF_2^-$, which cannot be detected by the electrode. In basic solutions with a low fluoride content (less than $10^{-4}$ M at a pH of 9.5 or above), the electrode responds to hydroxide ion as well as to fluoride ion. Samples containing aluminum or iron cause low results due to complexation with $F^-$. The total ionic strength of samples and standards must also be held constant for accurate measurement.

All of these problems are eliminated by diluting samples and standards with a special buffer solution which adjusts the pH, and ionic strength and unbinds fluoride if aluminum or iron is present.

Results obtained by this method are precise to ±5% relative at the 10 ppm level and 2% relative at the 10 ppm to 10% level.

Reagents and Apparatus:

1. Sodium Hydroxide, 0.001 N. Dilute 2 mls of 0.5 N NaOH to 1 liter with distilled water.
2. Total Ionic Strength Adjustment Buffer (TISAB). Add 114 ml of glacial acetic acid, 116 g of sodium chloride (NaCl), and 0.60 g of sodium citrate to 1000 ml of water in a two liter beaker. Stir to dissolve. Place the beaker in a water bath to cool, and using a pH meter, adjust the solution to a pH between 5.0 and 5.5 with 50% KOH or NaOH. Cool to room temperature, pour into a two liter volumetric flask, add distilled water to the mark and mix.

3. Fluoride Standard Solutions—Place 0.2211 g of NaF in a one liter volumetric flask and dilute to volume with 0.001 N NaOH. Mix and label 2000 ppm $F^-$ standard. Pipet 200 ml of above into a one liter volumetric flask and dilute to volume with 0.001 N NaOH. Mix and label 400 ppm $F^-$ standard. Store all fluoride ($F^-$) standards in plastic bottles. 40 ppm std. is prepared by diluting 20 ml of 2000 ppm std. to 1000 mls with 0.001 N NaOH.
4. Oxygen Flask Assembly, Cat. No. 6514-F20; A. H. Thomas Co., Philadelphia, Pa. 19105.
5. Meter, Orion Model 901.
6. Fluoride Ion Activity Electrode, Orion Model 94-09.
7. Reference Electrode, Orion Model 90-01.
8. Specific Ion Electrode Holder, Orion Model 92-00-01.
9. Sample Carrier, Cat. No. 6514-F45; A. H. Thomas Co., Philadelphia, Pa. 19105.
10. Thomas-Ogg Ignition Cabinet, Cat. No. 6516-G10, A. H. Thomas Co., Philadelphia, Pa. 19105.

A. Weigh 0.10 to 0.15 g of sample and record the weight to 0.0001 g.
B. Wrap the sample in black filter paper and place wrapped sample in a combustion basket. Hang the basket on the glass hook of the combustion flask stopper.
C. Pipet 20 mls of 0.001 N NaOH into the combustion flask.
D. Purge the flask with oxygen for one minute and immediately insert sample and stopper. Clamp stopper in place.
E. Place flask in combustion cabinet and adjust flask and lamp position so that the top of the black paper is in line with the lamp. Close and latch cabinet door.
F. Turn lamp switch "ON" until paper ignites.
G. After combustion is complete, remove flask from cabinet. Top of flask will be hot. Bottom of flask will be cool enough for handling.
H. Cool the top of the flask under tap water then rotate the flask to wash down all surfaces of the interior of the flask with the solution in the flask.
I. Pour the solution from the flask into a plastic cup.
J. Pipet 20 mls of TISAB solution into the flask. Stopper the flask and rotate the flask to rinse all interior surfaces.
K. Combine the solution with the solution from Step I.
L. Meter Calibration:
   1. Pipet 20 mls of 400 ppm $F^-$ Std. into a plastic cup.
   2. Pipet 20 mls of 40 ppm $F^-$ Std. into a plastic cup.
   3. Add a stirring bar and 20 mls of TISAB to each cup.
   4. Place the dry electrodes into the 400 ppm cup. Turn MODE switch to CONCN. Adjust STD VALVE to 400. Press SET CONCN button after reading stabilizes.
   5. Remove the 400 ppm cup and blot electrodes dry with tissue.
   6. Place the electrodes in the 40 ppm cup. Allow reading to stabilize. Adjust the SLOPE control to give a reading of 40.0.
M. Record meter readings for sample solution from Step K.
N. Calculations:*

*The meter reading (in millivolts) is related to fluoride concentration from a Table prepared using known fluoride concentrations.

$$\text{ppm Fluorine} = \frac{\text{ppm } F^- \text{ from meter}}{\text{Wt. of sample}}$$

Preparation of Modified Resin

(A)

Into a suitably equipped kettle, inserted with nitrogen, are added the following parts by weight:

Monobutyl Ether of Ethylene Glycol—91.567
Normal Butanol—32.503
Ethyl Acrylate—14.453
Tertiary Butyl Perbenzoate—0.026

In a separate vessel, the following are added and mixed:

Ethyl Acrylate—54.764
Methacrylic Acid—122.060
Styrene—72.919
Normal Butanol—2.050
Tertiary Butyl Perbenzoate—2.351

The reactor is heated to reflux and the monomer mixture is added evenly to the refluxing reactor over a two-hour period. Then 7.932 parts of monobutyl ether of ethylene glycol are added as a rinse for monomer feed lines. Reflux is maintained for one hour, at which point 55.500 parts of normal butanol is aded. Reflux temperatures are maintained for an additional hour at which point the heat is turned off and 72.623 parts of normal butanol are added, followed by 82.312 parts of dimethyl ethanol amine and 246.940 parts of deionized water. The product is a solution of a styrene/ethyl acrylate/methacrylic acid//27.6/26.2/46.2 polymer at 30.8% solids in solvent, water and amine. The acid number of the product is 300.

(B)

Into a suitably equipped kettle, inserted with nitrogen, are added the following parts by weight:

Monobutyl Ether of Ethylene Glycol—8.400
"Epon 829"—86.978
Bisphenol A—46.835

The kettle charge is heated to 130°-140° C., heat removed and allowed to exotherm to 175°-200° C. After the exotherm is exhausted, heat is applied and the reaction mass is maintained above 165° C. for two hours after peak exotherm. At this point, a sample can be removed for determination of completion of reaction. Theoretical epoxy equivalent weight is 3000. 6.655 parts of monobutyl ether of ethylene glycol and 27.366 parts of normal butanol are added to dilute the reaction mass and cool it to 100° C.

121.131 parts of the neutralized acrylic polymer prepared in (A) are added rapidly following by 23.181 parts of deionized water. The mass is heated to reflux temperature and held for twenty-five minutes. Heat is turned off and 288.155 parts of deionized water, preheated to 70°-80° C. is added evenly over a one-hour period.

The resulting product contains about 77.8% epoxy resin and 22.2% acrylic resin, by weight, with an equivalent ratio of acid polymer/amine/epoxy of about 4.6/3.0/1.0. X is 3, and Y is 51.5.

EXAMPLE 1

This example demonstrates the effectiveness of a preferred aqueous dispersion of this invention when used as a primary spin-finish for manufacturing a bulked continuous filament carpet yarn of 66-nylon in a coupled spin-draw-bulk process.

Poly(hexamethylene adipamide) having a number average molecular weight of about 15,000 is melt spun in a conventional manner through a spinneret to provide 80 filaments having a trilobal cross-section with a modification ratio of 1.75. The molten filaments are solidified in a conventional manner using a cross-flow air quenching apparatus prior to contacting a feed roll followed by a pair of heated draw rolls and a hot air jet screen bulking apparatus of the type described in Breen & Lauterbach U.S. Pat. No. 3,781,949. Prior to the feed roll a primary spin finish composition is applied to the freshly solidified undrawn filaments by means of a conventional rotating finish roll which just touches the moving filaments and is partly immersed in a pan containing the finish. The finish of the invention consists of the following (% solids by weight):

7.87% polyethylene glycol and derivatives added as a 99% concentrate consisting of an n-butyl initiated random copolymer of ethylene oxide/propylene oxide 50:50 mol ratio (manufactured and sold as "Ucon" 50HB-170 by Union Carbide Corporation) adjusted to a pH of 7.2 by addition of oleic acid and potassium hydroxide;

1.12% of an ethoxylated castor oil, added from a 60% aqueous dispersion, consisting of one mole of castor oil reacted with about 200 moles of ethylene oxide ("Synlube" 106 manufactured by Milliken Chemical Co.);

4.5% of a perfluoroalkylester made from a mixture of fluorinated alcohols having the formula $C_nF_{2n+1}(CH_2)_mOH$ wherein n is 6 to 14 and m is 2 fully esterified with citric acid and made into a bis-urethane by reacting two moles of the citrate tri-ester with one mole of 1,6-hexamethylene diisocyanate; the fluorochemical is added from a 50% aqueous dispersion containg a small amount of sodium lauryl sulfate as a dispersing agent with some residual methyl isobutyl ketone solvent. The ketone solvent is removed by vacuum distillation to reduce it to less than 0.5% concentration;

0.75% of the modified resin reaction product (prepared as described above) of an acrylic terpolymer with 1 mole of a diquaternized polyalcohol formed by a reacting 2 moles of dimethyl ethanolamine with 1 mole of a diepoxide having a molecular weight of about 6000 and based on the condensation product of epichlorohydrin and bisphenol A. This reaction product is made in the presence of about 8.3% butyl cellusolve and 7% butanol which is subsequently stripped from the product to less than 2% concentration by steam distillation; and 85.75% water.

The primary finish is prepared by adding to a tank with mixing 165.4 lbs. of a 99% concentrate of the ethylene oxide/propylene oxide copolymer to 1310 lbs. of demineralized water followed by slow addition of 39.4 lbs. of a 50% aqueous dispersion of the ethoxylated castor oil whereupon mixing is continued until dissolved. To this are slowly added with mixing 281 lbs. of a 5.6% dispersion of the acrylic modified resin and then 184.9 lbs. of a 51.1% aqueous dispersion of the fluoroester citric acid urethane. Mixing is continued for twenty minutes. The percent solids of the finish is analyzed and the required amount of demineralized water is added to bring the percent solids to 14.25%.

The speed of rotation of the finish roll is such that it provides the spun filaments with about 0.45% finish solids on yarn. The yarn is drawn in a continuous operation over 2 pairs of conventional draw pins by a pair of draw rolls heated at 190° C. to a draw ratio of 2.9× and then bulked in a hot air bulking jet at a temperature of 210° C. and at a hot air pressure of 120 psig. After bulking the yarn proceeds to a conventional take up roll and windup. A secondary textile finish is applied to the yarn between the take up roll and the windup by continuously metering the finish through an orifice across which the yarn is running. 0.44% by weight of secondary finish solids are applied which consist of the following:

11.25% coconut oil.

3.75% of ethoxylated castor oil formed by reacting 1 mole of castor oil with 25 moles of ethylene oxide and 2 moles of oleic acid. ("Synlube" 728, Milliken Chemical Co.)

85% water.

Analysis of this yarn as made shows the presence of about 850 ppm fluorine by weight corresponding to about 0.14% of the fluoroester urethane.

A ply-twisted yarn is prepared from this yarn using a balanced singles and ply-twist of 3.5 turns per inch, Z/S, and the ply-twisted yarn is heat set in a conventional manner in the "Superba" process at 280° F. The ply-twisted yarn is tufted into a carpet backing using 5/32 inch gauge to produce a carpet weight of 32 oz. per yard$^2$ tufted at a ½" pile height. A portion of the carpet is dyed in a Beck at a pH of 9 to 10 yards per minute using 0.3% at Acetamine Yellow CG dye.

Analysis of dyed yarn taken from the carpet shows the presence of 208 ppm fluorine.

A control carpet is made from yarn prepared in substantially the same manner without the antisoil spin-finish composition of the invention but with a primary finish comprising a 15% suspension in water of a mineral oil lubricant and an emulsifier and a secondary finish comprising a 20% dispersion of mineral oil lubricant and an emulsifier. The control carpet is subjected to the same dyeing procedure.

A second control carpet is made from yarn prepared without any antisoiling composition but the carpet made therefrom is topically treated with a commercial antisoiling treatment "Teflon CSF", E. I. du Pont de Nemours and Company, containing a fluoroester and a hardener resin, at a level from about 0.1 to 0.3% by weight on yarn in the conventional manner.

The antisoiling performance of the two control carpets and the test carpet are tested in a conventional floor test subjected to normal foot traffic in a busy office corridor and traffic exposure of the samples is counted. Soiling performance is evaluated through visually rating the test samples versus a calibrated scale to observe the change of appearance of the carpets with traffic exposure. The scale consists of identical carpet samples containing different levels of soil covering the TRISTIMULUS $\Delta E$ reflectance values from 0 to 25 in 6 equal intervals where rating of $\Delta E=O$ is an unsoiled sample.

After 16,000 traffic cycles the untreated control is rated as 6.0, the topically treated control is rated at 4.3 and the test carpet is rated as 4.0 showing it to perform even better than the topically treated control.

This example is repeated except that the secondary finish is comprised of the same ethoxylated castor oil as used in the primary finish. Carpets made from controls and the test yarn are again floor tested in a very busy corridor for 200,000 cycles. The test yarn as prepared contains 826 ppm of fluorine. In this floor test the test carpet of the invention again is found to appear less soiled than either of the controls.

PEG-600, a polyethylene glycol, is tested as a lubricant in the same type of primary finish but tends to give slightly less antisoiling performances.

EXAMPLE 2

This example demonstrates the use of an antisoiling textile finish composition of the invention on staple fibers of 66-nylon when applied as a primary spin finish.

Oriented carpet staple fibers of poly(hexamethylene adipamide) having a denier per filament of 18 and a trilobal cross-section with a modification ratio of 1.65 are prepared in a conventional manner. Filaments are melt spun from a spinneret and solidified in cross flowing air. The freshly solidified filaments are passed against a conventional finish applicator roll rotating partially immersed in a bath of a primary spin finish. The undrawn filaments are collected as a tow in a container. Twelve ends of the tow are then combined and drawn 3.0× their original length on a conventional draw machine and passed into a stuffer box crimping machine. To facilitate crimping operability 1.5% of the ethylene oxide/propylene oxide finish component of the primary finish is applied at the crimper. The drawn and crimped tow is collected in a container and subsequently fed into a fiber cutter to produce staple fibers having a cut length of 7.5 inches.

The primary spin finish is substantially the same as Example 1 except applied at a solids concentration of 9%. The fibers as-spun are found to contain 771 ppm of fluorine by analysis. The staple fibers are processed by conventional means into spun yarns which in turn are twisted and plyed 4.5 tpi Z and 3.5 tpi S respectively to form a two-ply 3.2/2 cotton count twisted yarn. The yarn is then skeined, tumbled (145° F. for 5 minutes with steam, 3 minutes without steam) and heat set at 270° F. It is tufted into a commercial polypropylene backing, "Polybac", at 5/32 in. gauge, ¾ in. pile height to give a carpet weight of 40 oz. per yd$^2$. The carpet is dyed under conventional conditions in a Beck using 0.3% Acetamine Yellow CG dye. A pH of 9.0 is used in the dye bath. After dyeing, analysis of the yarn shows the presence of about 251 ppm of fluorine.

The antisoiling performance of the carpet is tested as in Example 1 using an untreated control and a topically treated control with a commercial antisoiling preparation. After 16,000 cycles the test carpet is found to perform significantly better than the untreated carpet and almost as good as the topically treated control.

EXAMPLE 3

A bulked continuous filament carpet yarn of 66-nylon is made using substantially the same process as in Example 1 except that the yarn has a denier of 1776 and the filaments are of 10 denier per filament. The primary spin finish is applied to the freshly solidified undrawn filaments by means of a slot applicator instead of a rotating finish roll and the primary finish consists of (by weight of solids) 10% of a high molecular weight ethylene oxide/propylene oxide lubricant with a SUS viscosity of 5100, 2% of the same fluorochemical, 1% of the same acrylic modified epoxy resin and 1% of sodium dioctyl sulphosuccinate ("Aerosol" OT manufactured by American Cyanamid) and 86% water. About 0.4% by weight of finish solids are applied to the yarn. A secondary finish is applied as in Example 1 but the composition is 10% of the ethylene oxide/propylene oxide composition used in the primary finish of Example 1 in 90% water. Analysis of the yarn as made shows 360 ppm fluorine. Test carpets are prepared and dyed in Example 1 and after dyeing analysis of the fabric shows only 128 ppm of fluorine. Antisoiling performance is tested as in Example 1 and compared with untreated and topically treated control carpets. After 16,000 cycles the test carpet is found to be only marginally better than the untreated control and not as good as the topically treated control, indicating that this amount of retained fluorine on yarn is only marginally effective.

Example 1 is substantially repeated except that the concentration of the ethylene oxide/propylene oxide lubricant in the finish bath is 7.5% and ethoxylated castor oil lubricant is 1.125%. The other additives are at the same concentration. The spun filaments are found to contain about 0.3% by weight of the primary finish and yarn analysis shows the presence of 540 ppm fluorine. Analysis of yarn from dyed carpet shows 220 ppm of fluorine. The antisoil floor performance of the test carpets after 16,000 cycles shows the test carpet to be equivalent to the topically treated control carpet and considerably better than the untreated control carpet.

EXAMPLE 4

This example demonstrates the effect of varying the ratio of fluorochemical to the modified resin in the primary finish of Example 1. Bulked continuous filament yarns of 66-nylon are prepared as in Example 1 except that the primary finish contains 7.0% of the ethylene oxide/propylene oxide lubricant, 1.0% of the ethoxylated castor oil lubricant, 4.0% of the fluorochemical and different amounts of the modified resin as follows:

Item A13 2.0% of the same acrylic terpolymer/-diquaternized polyalcohol resin giving a ratio of fluorochemical to modified polymer of 2:1;

Item B—1.0% of the modified resin to give a ratio of 4:1;

Item C—0.67% of the modified resin to give a ratio of 6:1;

Yarns of each of these items are spun to provide about 800 ppm of fluorine on yarn. The same secondary finish is used as in Example 3. Analysis of the bulked yarn as made shows fluorine as 1000 ppm, 780 ppm and 732 ppm for Items A, B and C respectively. Analyses of these yarns taken from carpet after dyeing reveal 437, 371 and 372 ppm of fluorine respectively. The antisoiling performance of the carpets tested as in Example 1 shows the untreated control to have a rating of 5.0, the topically treated control 3.9, and the test items to be 4.0, 3.9 and 3.1 respectively. Item C found to perform the best has a fluorochemical to modified resin ratio of 6:1.

Other tests are made at a fluorochemical to modified resin ratio of 15:1 and 50:1 in similar finishes with inferior results.

What is claimed is:

1. A durable antisoiling coating composition for textile filaments comprising an aqueous dispersion of (1) a perfluoroalkylester of a citric acid urethane and a fluorinated alcohol having the formula $C_nF_{2n+1}(CH_2)_mOH$ wherein n is 6 to 14 and m is 2 and of (2) the reaction product of (A) not less than 50% by weight, based on the weight of (A) plus (B), of an eoxy resin containing, on the average, two terminal 1,2-epoxy groups per molecule and having an epoxy equivalent weight of 750–5000;

(B) a caboxyl-functional polymer in an amount sufficient to provide at least 1.25 equivalents of carboxyl groups, when the source of the carboxyl group is a mono-protic acid, and at least 2.0 equivalents of carboxyl groups, when the source of such groups is a diprotic acid, per equivalent of 1,2-epoxy groups in the epoxy resin, said polymer having a weight average molecular weight (determined by light scattering) of about 10000–160000 and an acid number of 100–500;

(C) an aqueous solution of at least 1.25 equivalents of a tertiary amine per equivalent of 1,2-epoxy groups in the epoxy resin, said tertiary amine being selected from the group consisting of $R_1R_2R_3N$, pyridine, N-methylpyrrole, N-methyl piperidine, N-methyl pyrrolidine, N-methyl morpholine, and mixtures thereof and wherein $R_1$ and $R_2$ are substituted or unsubstituted monovalent alkyl groups containing one or two carbon atoms in the alkyl portion and $R_3$ is a substituted or unsubstituted monovalent alkyl group containing 1–4 carbon atoms; and (D) optionally, 10–90% of the amount required for stoichiometric reaction with the carboxy-functional polymer of (B) of at least one primary, secondary or tertiary amine or monofunctional quaternary ammonium hydroxide;

wherein Y is at least about $6+0.75(2^X)$ wherein Y is the milliequivalent of carboxyl groups neutralized with primary, secondary or tertiary amine or mono-functional quaternary ammonium hydroxide per 100 grams of acid polymer plus epoxy, and X is the epoxy equivalent weight divided by 1000; and wherein for increasing ratios of carboxyl groups to 1,2-epoxy groups, the amount of amine is increased to keep the carboxyl-functional polymer water dispersible; with said ester being present in said dispersion in a ratio in parts by weight to said reaction product within the range of about 1:1 to 12:1.

2. A composition of claim 1 wherein the ester-urethane is formed from said ester of citric acid and an aliphatic $\alpha,\psi$-diisocyanate; the carboxyl-functional polymer is a terpolymer of styrene, ethylacrylate and methacrylic acid; and the ratio of the ester to said reaction product is within the range of 4:1 to 8:1.

3. A composition of claim 2 wherein the diisocyanate is 1,6-hexamethylene diisocyanate; the terpolymer is of styrene/ethylacrylate/methacrylic acid in a mole ratio of about 1/1/2 respectively; the tertiary amine is dimethylethanolamine; and the diepoxide is a condensation product of epichlorohydrin and bisphenol A; and the reaction product being formed at ratios of about 2 mols of terpolymer to 1 mol of the diquaternized polyalcohol formed from 2 mols of the amine and 1 mol of the diepoxide.

4. A composition of claim 1, 2 or 3 wherein the dispersion includes a non-ionic textile lubricant based on a polymer of poly(ethylene glycol).

5. A composition of claim 4 wherein the lubricant comprises a mixture of a 50/50 random copolymer of ethylene oxide/propylene oxide and of ethyoxylated castor oil, and the ratio by weight of lubricant to ester is in the range of about 2:1 to 1:1.

6. A composition of claim 5 wherein the dispersed ingredients consist essentially of said ester, said reaction product and said lubricant, said ingredients being present at a total concentration by weight of from 5 to 25%.

* * * * *